US009581049B2

(12) United States Patent
Helbig et al.

(10) Patent No.: US 9,581,049 B2
(45) Date of Patent: Feb. 28, 2017

(54) WARMING ARRANGEMENT FOR A POWER PLANT

(71) Applicant: ALSTOM Technology Ltd, Baden (CH)

(72) Inventors: Klaus Helbig, Mannheim (DE); Christian Kuehne, Frankenthal (DE); Wolfgang Franz Dietrich Mohr, Niederweningen (CH)

(73) Assignee: General Electric Technology GmbH, Baden (CH)

( * ) Notice: Subject to any disclaimer, the term of this patent is extended or adjusted under 35 U.S.C. 154(b) by 96 days.

(21) Appl. No.: 14/095,424

(22) Filed: Dec. 3, 2013

(65) Prior Publication Data

US 2014/0150430 A1 Jun. 5, 2014

(30) Foreign Application Priority Data

Dec. 3, 2012 (EP) ..... 12195309

(51) Int. Cl.
*F01K 13/02* (2006.01)
*F01D 25/10* (2006.01)
*F01D 19/02* (2006.01)

(52) U.S. Cl.
CPC ..... *F01K 13/02* (2013.01); *F01D 19/02* (2013.01); *F01D 25/10* (2013.01); *F05D 2270/301* (2013.01)

(58) Field of Classification Search
CPC ..... F01K 13/02; F01D 25/10; F05D 2270/301
USPC ..... 60/646, 656, 653, 654, 678
See application file for complete search history.

(56) References Cited

U.S. PATENT DOCUMENTS

| | | | | | |
|---|---|---|---|---|---|
| 2,650,794 | A | * | 9/1953 | Roder | F01D 25/10 415/144 |
| 3,991,603 | A | * | 11/1976 | Wonn et al. | 73/24.04 |
| 4,651,532 | A | * | 3/1987 | Abe | 60/646 |
| 4,674,285 | A | * | 6/1987 | Durrant et al. | 60/676 |
| 4,679,399 | A | * | 7/1987 | Strickler | 60/646 |
| 5,042,246 | A | | 8/1991 | Moore et al. | |
| 5,203,160 | A | * | 4/1993 | Ozono | 60/778 |
| 5,473,898 | A | | 12/1995 | Briesch | |
| 2004/0088984 | A1 | | 5/2004 | Gobrecht et al. | |
| 2009/0193787 | A1 | | 8/2009 | West et al. | |

(Continued)

FOREIGN PATENT DOCUMENTS

| | | | |
|---|---|---|---|
| EP | 2237023 | A1 * | 10/2010 |
| GB | 682568 | * | 2/1949 |

(Continued)

*Primary Examiner* — Thomas Denion
*Assistant Examiner* — Jessica Kebea
(74) *Attorney, Agent, or Firm* — GE Global Patent Operation; Cynthia W. Flanigan

(57) ABSTRACT

The invention relates to a warming arrangement having a warming system for warming a steam turbine. The warming system has a makeup line and recycle line fluidly connected to the steam turbine. A gas moving device and a heater are located in either of these two lines. The warming system further includes a pressure measurement device that is configured and arranged to determine a gauge pressure in the steam turbine as well as a controller. The controller is configured to control a flow rate of the warming gas through the steam turbine, based on the pressure measurement device.

12 Claims, 6 Drawing Sheets

(56) References Cited

U.S. PATENT DOCUMENTS

2011/0185744 A1 8/2011 Tong et al.

FOREIGN PATENT DOCUMENTS

| | | | | |
|---|---|---|---|---|
| JP | 56167803 | A | * | 12/1981 |
| JP | 61171807 | A | * | 8/1986 |
| JP | 09303110 | A | * | 11/1997 |
| JP | 10331610 | A | * | 12/1998 |
| JP | 2002070506 | A | * | 3/2002 |
| JP | 2003020905 | A | * | 1/2003 |

* cited by examiner

WARMING ARRANGEMENT FOR A POWER PLANT

CROSS-REFERENCE TO RELATED APPLICATIONS

This application claims priority to European application 12195309.5 filed Dec. 3, 2012, the contents of which are hereby incorporated in its entirety.

TECHNICAL FIELD

The present disclosure relates generally to power plants and more specifically to warming systems for steam turbine plants that prepare the steam plant for either start-up or stand-by operation.

BACKGROUND

Shortening start-up times and improving starting reliability while increasing the number of starts is one of many new requirements with respect to plant flexibility that has arisen as a result of the increased use of renewable energy sources such as solar and wind.

A major factor limiting the load output of an existing combined cycle power plant is the allowed pressure and temperature transients of the steam turbine and the heat recovery steam generator as well as the waiting time required to establish warm-up times in the balance of plant and the main piping system. These limitations may also influence the start-up capability of the gas turbine of a combined cycle plant by linking the start-up of the gas turbine with the start-up of the steam turbine.

A method of warming a steam turbine involves using main steam generated from the start-up of a gas turbine or auxiliary steam from other sources generated from within the power plant. This pre-warming is required even for small steam turbines in order to avoid differential temperatures between inner and outer walls of the steam chest, and within the rotor. Unless this is done before the unit is exposed to nominal steam system pressures and temperatures, temperature differentials may create excessive stress in the turbine and/or the turbine steam control valve(s).

Larger steam turbines typically include the step of rolling the turbine during pre-warming. If steam is used to pre-warm the turbine, this introduces further constraints on the pre-warming process by restricting the flow rate of the pre-warming medium. For example, is the turbine is being rolled during the pre-warming process, if the flow rate of the pre-warming medium is too high through the nominal steam path, the turbine may rolling-off the turning gear as it accelerates prematurely. However, lower pre-warming medium flow rate will increase the heat-up time.

US Patent Application No. 2004/0088984 A1 describes a method for operating a steam turbine within a Rankine cycle comprising several no-load or light load and further distributing steam to individual stages during idle or low-load operation. This is achieved by measuring an enthalpy difference across a steam turbine stage and controlling a bypass around the steam turbine based on the enthalpy measurement so as to minimise the enthalpy difference.

An alternative to steam pre-warming is discussed in U.S. Pat. No. 5,473,898. This solution, which is applicable only to combined cycle power plants where the gas turbine compressor is in operation, involves directing hot air bled from the gas turbine air compressor through the flow path of the steam turbine to pre-warm a steam turbine. As the compressed air is sourced from the gas turbine system, this solution, like the solutions discussed previously, links the start-up of the gas turbine with pre-warming of the steam turbine and therefore has only a limited effect on overall start-up time and further cannot be used to keep the steam turbine on hot standby.

SUMMARY

Provided is a pre-warming arrangement for a power plant that is capable of drying, warming or pre-warming steam turbines of a power plant while overcoming the problem of the coupling of the pre-warming with either the start-up of other major equipment items of the power plant or else auxiliary equipment of the power plant.

It addresses this problem by means of the subject matter of the independent claims. Advantageous embodiments are given in the dependent claims.

An aspect provides an arrangement for a power plant that has a first steam turbine, for expanding steam. The arrangement has a warming system, for warming the first steam turbine by a first warming gas that further has a makeup line, a recycle line, a gas moving device and a heater. The makeup line is fluidly connected to the first steam turbine and serves the purpose of directing the first warming gas into the first steam turbine, while the recycle line, which is also fluidly connected to the first steam turbine, serves the purpose of conveying the warming gas from the first steam turbine. The gas moving device, located in either for first makeup line or recycle line, is the motive means for moving the warming gas through the warming system. A heater is provided in either the first makeup line or the recycle line to heat the first warming gas before entering the steam turbine. The warming system further comprises a pressure measurement device configured and arranged to determine a gauge pressure and in the steam turbine and a controller that is configured to control a flow rate of the first warming gas through the first steam turbine based on the first pressure measurement device.

In an aspect, the controller is configured and arranged to control the flow rate by means of either a control valve or the gas moving device.

In an aspect, the warming system includes at moisture measurement device located and arranged to estimate a moisture content of the warming gas in the steam turbine.

In an aspect the first steam turbine has a feed line and an exhaust line which in combination are arranged to direct a main steam through the steam turbine during normal operation, wherein the makeup line and the recycle line are distinct and separate lines from the feed line and either the makeup line or the recycle line.

In an aspect, the feed line includes a feed valve wherein the recycle line is connected to the feed line so as to enable the flow of the warming gas from the recycle line into the steam turbine via the feed line.

In a further aspect the makeup line and the recycle line each include at least one block valve, for isolating the first warming system from the first steam turbine during normal operation of the steam turbine.

In an aspect, the first warming system includes a first moisture measurement device located and arranged to estimate a moisture content of the warming gas in the first steam turbine to enable controlled drying of the steam turbine.

In a further aspect the moisture measurement device is located in the first steam turbine.

In an aspect the arrangement further comprises a heat recuperator, spanning the makeup line and the recycle line that is capable of exchanging thermal energy between warming gas flow through the makeup line and the recycle line respectively.

In an aspect, the gas moving device is located in the makeup line upstream of the heat recuperator.

In an aspect, an end of the recycle line is connected to the makeup line so by creating a circular warming gas flow path that includes the steam turbine, the gas moving device and the heater.

In a further aspect the recycle line is connected to the makeup line by means of a control valve wherein the control valve includes a warming gas flow path therethrough from outside the circular flow path to inside and the circular flow path and from the first recycle line to the first makeup line. This configuration of control valve makes it possible to vary a flow ratio of warm gas entering the circular flow path and circulating around the circular flow path by a mixer.

In an aspect, the warming arrangement further comprises a second steam turbine and a second warming system for warming the second turbine using a second warming gas.

In a further aspect the second warming system further comprises a third steam turbine for further expanding steam from the second steam turbine and a condenser connected to an outlet of the third steam turbine wherein the second steam turbine is connected to the third steam turbine by means of a feed line in the form of either a cross over or a combined casing.

An aspect provides that the or each steam turbine includes a plurality of makeup lines axially distributed along the steam turbine so as to feed a plurality of warming gas streams into the turbine. This enables the warming of the steam turbine to achieve temperature staging within the steam turbine. A further aspect includes a temperature measurement device that is connected to the controller wherein the temperature measurement device is configured and arranged to measure a temperature of the steam turbine, such as a metal temperature or an internal temperature such as warming gas.

An aspect provides a method for controlling the warming of a steam turbine that involves flowing a warming gas'through a steam turbine. The method includes determining a gauge pressure in the steam turbine and varying a flow rate of a warming gas through the steam turbine based on the measured pressure.

It is a further object of the invention to overcome or at least ameliorate the disadvantages and shortcomings of the prior art or provide a useful alternative.

Other aspects and advantages of the present disclosure will become apparent from the following description, taken in connection with the accompanying drawings which by way of example illustrate exemplary embodiments of the present invention

BRIEF DESCRIPTION OF THE DRAWINGS

By way of example, an embodiment of the present disclosure is described more fully hereinafter with reference to the accompanying drawings, in which.

DETAILED DESCRIPTION

Figure 1:
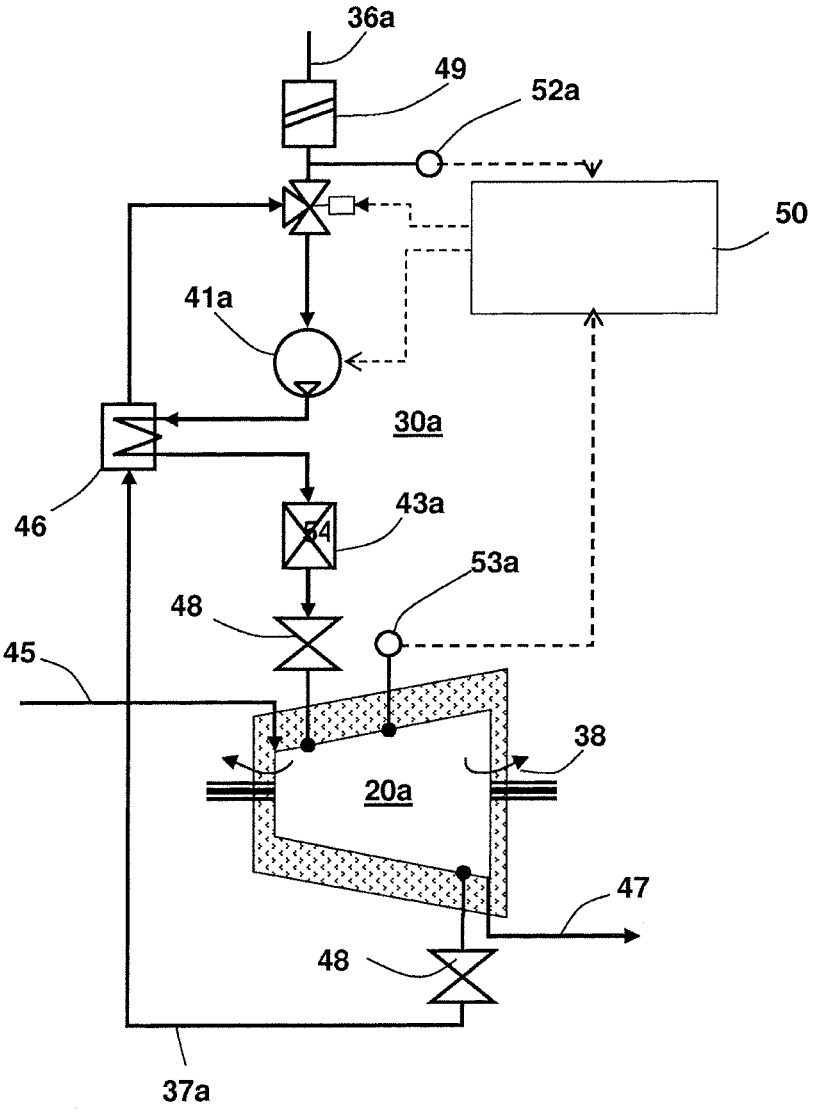
FIG. 1 is a schematic of an arrangement of a power plant with closed loop heating of an exemplary embodiment having heat recuperation.

Exemplary embodiments of the present disclosure are now described with references to the drawings, wherein like reference numerals are used to refer to like elements throughout. In the following description, for purposes of explanation, numerous specific details are set forth to provide a thorough understanding of the disclosure. However, the present disclosure may be practiced without these specific details, and is not limited to the exemplary embodiments disclosed herein.

Within this specification the term gas in is most generic form and thus includes steam, flue gas and any inert gases such as nitrogen.

FIG. 1 shows an exemplary steam turbine 20*a* of a power plant having a warming system 30*a* for either pre-warming, warming or keeping warm a steam turbine 20*a*. In an exemplary embodiment the warming system 30*a* comprises a makeup line 36*a*, a recycle line 37*a*, a gas moving device 41*a*, and a heater 43*a*.

A function of the system is to direct warming gas through the warming system 30*a* so by providing a means of warming the steam turbine 20*a*. In an exemplary embodiment shown in FIG. 1 this is achieved by the makeup line 36*a* directing warming gas to the steam turbine 20*a* where it flows out of the steam turbine 20*a* via the recycle line 37*a*.

In an exemplary embodiment shown on FIG. 1, the gas entering the warming system 30*a* may be treated in a gas preparation unit 49 that polishes the entering gas to ensure that contaminants are not deposited in the steam turbine 20*a*.

The heater 43*a*, located in the makeup line 36*a*, heats the warming gas to enable the warming gas to warm the steam turbine 20*a*. The heating maybe achieved by the use of a secondary heating transfer medium, such as steam or oil or else by any other known means including electric heating or by combustion. In a not shown exemplary embodiment, this function is performed either partially or completely by utilising the thermodynamic effects of compression generated by the gas moving device 41*a* located in either the makeup line 36*a*, as shown in FIG. 1, or in the recycle line 37*a*.

The gas moving device 41*a* may be any device that can drive warming gas through the warming system 30*a*. For example, a fan or mechanically equivalents thereof such as a pump, blower or a compressor, both canned and sealed, may serve the purpose of a gas moving device 41*a*. Other devices that do not have mechanically moving component, such as devices utilising the venturi principle may also serve as a gas moving device 41*a*.

Although the heater 43*a* and the gas moving device 41 a are shown as separate units in FIG. 1, an exemplary embodiment includes a combined heater 43*a* and gas moving device 41*a* unit. An example of such a unit includes a gas turbine or stroke engine.

Figure 2:
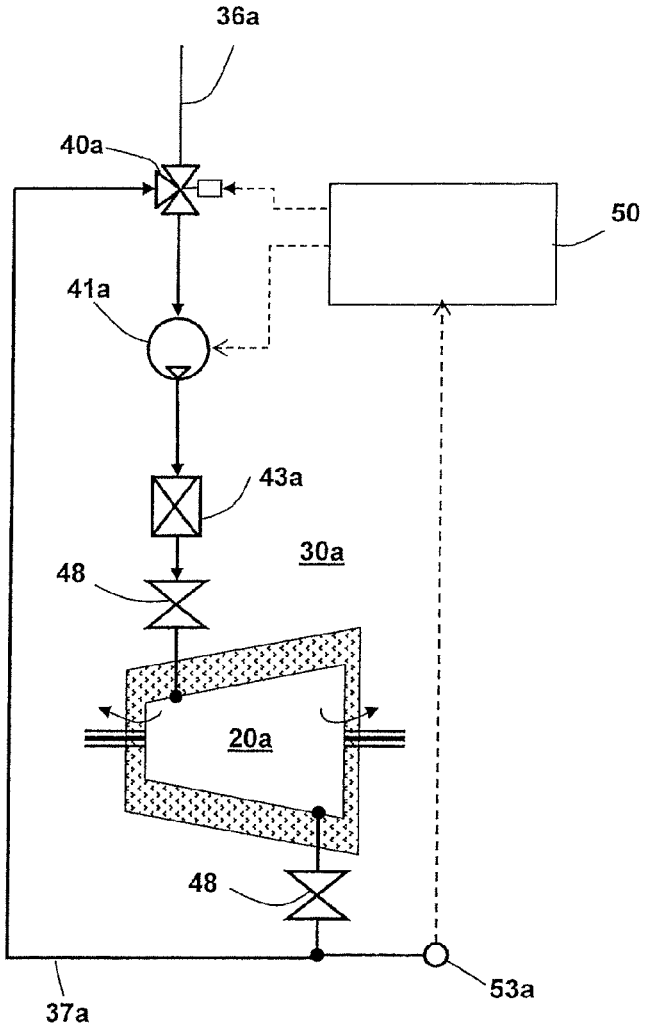
FIG. 2 is a schematic of a power plant with another closed loop pre-warming arrangement of an exemplary embodiment without heat recuperation.

In an exemplary embodiment shown in FIGS. 1 and 2 a, the warming system 30*a* is configured as a closed loop system comprising a recycle line 37*a* connecting to the makeup line 36*a* and containing the gas moving device 41*a*, the heater 43*a* and the steam turbine 20*a*. In another not shown exemplary embodiment, the vent function of the closed loop system is performed by a dedicated vent 38 that is connected to either the makeup line 36*a*, the steam turbine 20*a* or the recycle line 37*a*. In an exemplary embodiment shown in FIG. 1 the sealing gland form is a vent 38. This closed loop arrangement makes it possible for some of the warming gas to flow in a continuous loop around the warming system 30*a* and thus reduce the amount of makeup/bleed required and/or, reduce the heater 43*a* load required to hold the steam turbine 20*a* at a given temperature. In this way, in conjunction with insulation, an energy efficient means is provided to keep the steam turbine 20*a* on hot standby. In an example embodiment of a closed loop warming system 30*a* shown in FIGS. 1 and 2 the recycle line 37*a* is connected to the makeup line 36*a* by means of a control valve 40*a*, which, by being configured to be an output variable of the controller 50, it is possible to vary a flow ratio of warm gas entering the circular flow path and circulating around the circular flow path and vary process parameters of the warming system 30*a* such as moisture content.

As shown in FIG. 1, in a closed loop warming system 30*a* an exemplary embodiment further comprising a heat recuperator 46, spanning the makeup line 36*a* and the recycle line 37*a*, for exchanging thermal energy between warming gas flow through the makeup line 36 and the recycle line 37*a* respectively. Where the gas moving device 41*a* is temperature sensitive, it is advantageous to locate the gas moving device 41*a* in the makeup line 36*a* upstream of the heat recuperator 46, such that the gas moving device 41*a* is not exposed to heated warming gas.

The path of the warming gas through the steam turbine 20*a* is not limited to the nominal steam path through the steam turbine 20*a* but may include cooling flow paths, or else additional feed ports or extractions ports. As shown in FIG. 1, in an exemplary embodiment, feed lines 45 and exhaust lines 47 of the steam turbine 20*a* that form the main steam flow path through the steam turbine during normal operation, do not form part of the warming system 30*a*. That is, the feed line 45 and exhaust line 47 of the steam turbine 20*a* are distinct from the warming system and thus also excludes secondary flow paths such as cooling or purging flow paths.

As shown in FIG. 1 an exemplary embodiment includes block valves 48 located in the makeup line 36*a* and the recycle line 37*a* the entry and exit points of the turbine 20*a* respectively. This makes it possible for the warming system 30*a* to be isolated from the turbine 20*a* during operation.

The direction of warming gas flow through the steam turbine 20*a* as shown in FIG. 1 is in an exemplary embodiment from the high pressure side of the steam turbine 20*a* to the low pressure side of the steam turbine. Alternative flow paths are also possible provided they meet the criteria of ensuring good contact of the warming gas with all parts of the steam turbine 20*a* so that uniform heating can be achieved. For example, in a not shown exemplary embodiment, the warming gas flow path may be arranged to direct warming gas from the high pressure side of the steam turbine 20*a* to the low pressure side. In yet another example the flow path may be arrange to direct warming gas into the middle of the turbine and then direct the warming as in two directions such that the warming gas exits the steam turbine 20 from the low pressure and high pressure ends of the steam turbine 20 simultaneously.

In an exemplary embodiment shown in FIG. 1, the warming system 30*a* includes a pressure measurement device 53*a* to determine a pressure in the steam turbine 20*a*. The pressure measurement device 53*a* is located in the warming system 30*a* so that a pressure inside of the steam turbine 20*a* can either be directly measured, inferred or determined. For example, in an exemplary embodiment shown in FIG. 1 the pressure measurement device 53*a* is located in the steam turbine, while in another exemplary embodiment shown in FIG. 2 the pressure measurement device 53*a* is located in recycle line 37*a* close to the steam turbine 20*a*.

Figure 3:
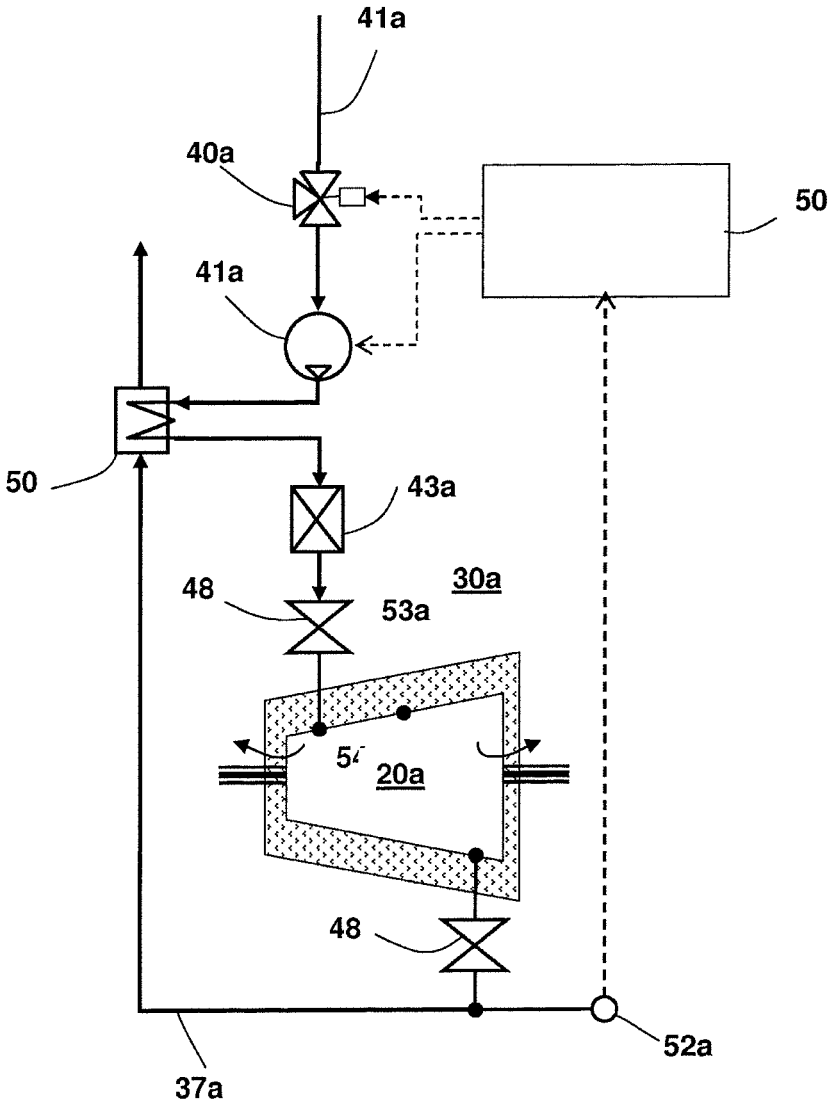
FIG. 3 is a schematic of a power plant with an open loop pre-warming arrangement of an exemplary embodiment wherein the warming system is arranged as an open loop warming system.

The exemplary embodiments shown in FIG. 1 further includes a controller 50 that is configured to control a flow rate of the first warming gas through the first steam turbine 20*a* by manipulating the control valve 40*a* or, in another exemplary embodiment, by manipulating a variable of the gas moving device 41*a*. In this way, the control is based on the pressure measurement device 53*a* and can achieve a purpose of preventing the pressure from dropping to a level at which air may be allowed to ingress into the steam turbine 20*a* while also minimising losses from the warming system through vents 38, feed lines 45 and exhaust lines 47. The throughput of the gas moving device may be varied by the controller 50 to achieve the control purpose. The means by which the flow rate is varied includes any part of the gas moving device 41*a* capable of changing the volumetric throughput capacity of the gas moving device 41*a*. An example includes inlet and/or outlet guide vanes, variable speed drive devices and other known capacity varying means.

in another exemplary embodiment shown in FIG. 3 the warming system is configured as an open system. That is, warming gas passes once through the steam turbine 20*a* without being returned to the makeup line 36*a*. This arrangement provides an efficient means of drying the steam turbine 20*a* as moisture laden is not recycled in the warming system 30*a*

As shown in FIG. 3, in an open loop warming system 30*a* an exemplary embodiment further comprising a heat recuperator 46, spanning the makeup line 36*a* and the recycle line 37*a*, for exchanging thermal energy between warming gas flow through the makeup line 36*a* and the recycle line 37*a* respectively. This makes it possible to recover some of the thermal energy in the warming gas exiting the steam turbine 20, thus reducing the heating requirement of the warming gas without the need for recycle of the warming gas. In a variation of the exemplary embodiment where the gas moving device 41*a* is temperature sensitive, the gas moving device 41*a* is located in the makeup line 36*a* upstream of the heat recuperator 46 so that the gas moving device 41*a* is not exposed to heated warming gas.

As shown in FIG. 3, an exemplary embodiments further includes a moisture measurement device 52*a* in the recycle line 37*a* that forms another input into the controller 50. By manipulating variables such as flow rate in the cycle and heat input of the heater 43*a* the controller 50 is able of controlled drying of the steam turbine 20*a*.

Figure 4:
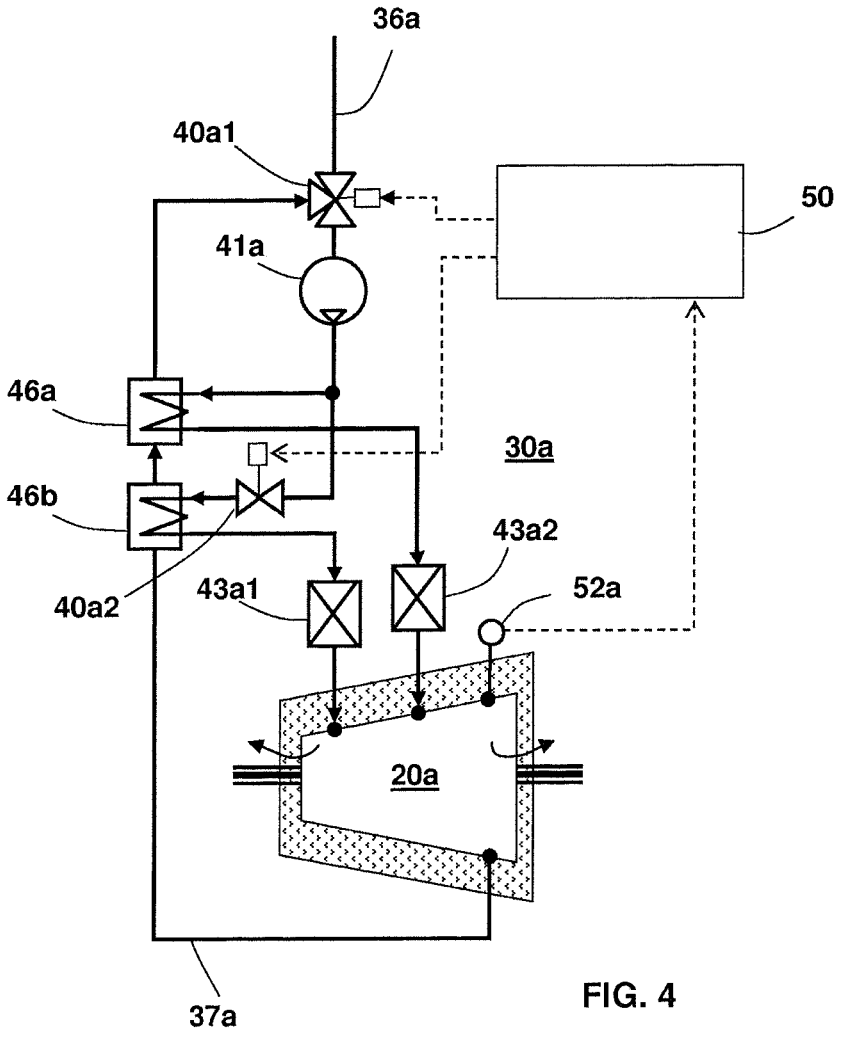
FIG. 4 is a schematic of a power plant with a closed loop pre-warming arrangement of an exemplary embodiment wherein the warming system is configured for stage wise warming of a steam turbine.

As shown in FIG. 4, an exemplary embodiment includes a plurality of makeup lines 36) axially distributed along the steam turbine so as to feed a plurality of warm gas streams into the steam turbine 20*a*. This enables stage wise warming of the steam turbine to. A further exemplary embodiment shown in FIG. 4 includes a temperature measurement device 54 that is configured as a measurement variable of the controller 50. In an exemplary embodiment where the controller 50 is further connect to a control valve 40*a*2 located in the makeup line 36*a*, the controller 50 is capable of adjusting the relative warming gas flows through the plurality of warming gas entry points and thus provide staging temperature control of the warming of the steam turbine 20*a*. In a further exemplary embodiment shown in FIG. 4, the warming system 30*a* includes a second heat recuperator 46*b*, upstream of a first heat recuperator 46*a*. In a yet further exemplary embodiment shown in FIG. 4, each entry point to the steam turbine has a separate heater 43*a*1, 43*a*2.

Figure 5:
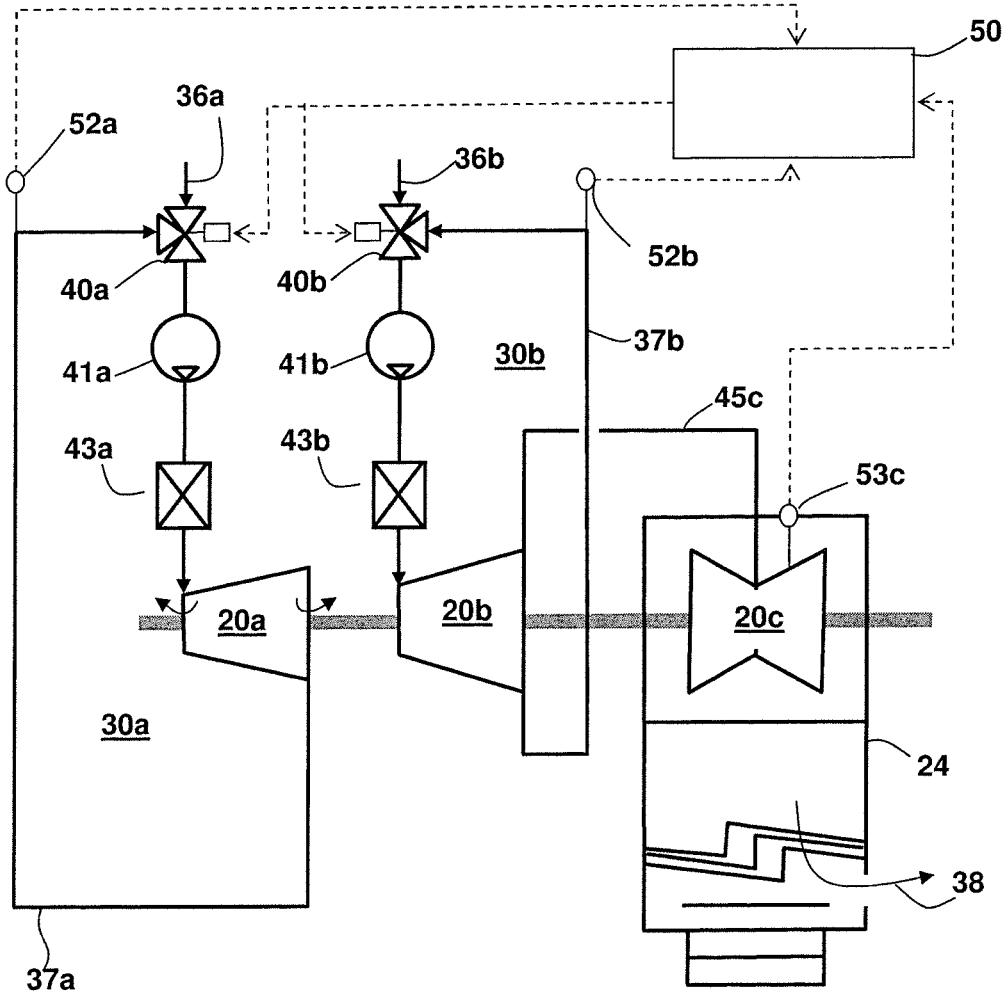
FIG. 5 is a schematic of a warming arrangement of a power plant that includes a series of steam turbines and the warming system of FIGS. 1, 2, 3 or 4 plus an additional warming system.
Figure 6:
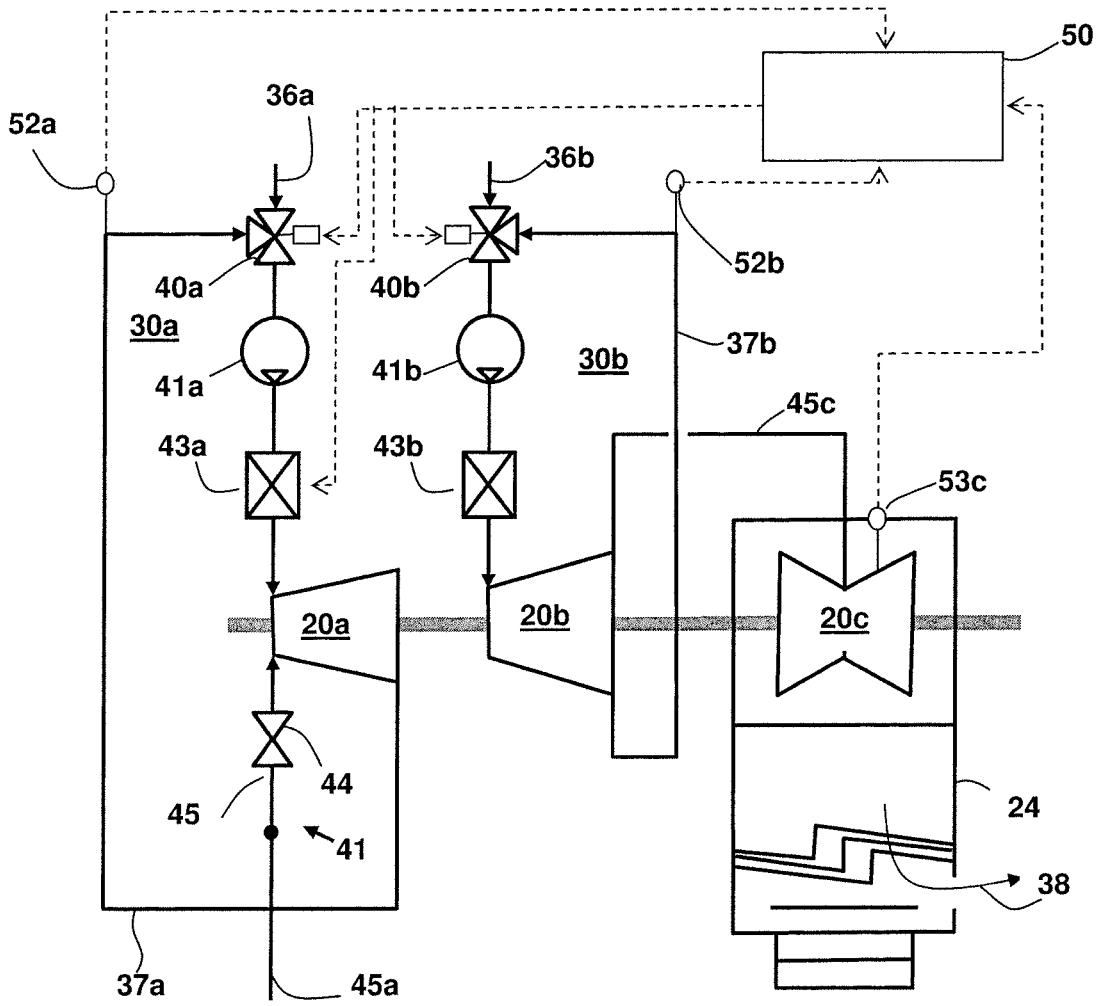
FIG. 6 is a schematic of the steam turbine power plant of FIG. 5 with additional turbine nominal feed line and valve pre-warming.

Exemplary embodiments shown in FIG. 5 and FIG. 6 include additional steam turbines 20*b, c*, located downstream of the first steam turbine 20*a* warmed by a second warming system 30*b*.

The exemplary embodiment shown in FIG. 5 comprises a second warming system 30*b* that includes a warming gas flow-path through an intermediate pressure steam turbine 20*b*, a low pressure steam turbine 20*c*, and a condenser 24 that is connected to the outlet of the low pressure steam turbine 20*c*. The exemplary second warming system 30*b* further includes a makeup line 36*a* for directing warming gas into the intermediate pressure steam turbine 20*b*. The makeup line 36*b* includes a control valve 40*b*, a gas moving device 41*b* and a heater 43*b*.

As shown in FIG. 5, in an exemplary embodiment, the control valve 40*b* is a flow-rate varying device for varying the amount of warming gas entering/ leaving the second warming system 30*b*. In another not shown exemplary embodiment, this function is performed by the gas moving device 41*b* which is configured to provide variable output, by, for example, having variable inlet and/or outlet guide vanes, variable speed capability or other known capacity varying means.

A fan is one example of a gas moving device 41*b* whose purpose is to provide the motive means to force warming gas through the second warming system 30*b*. It could be substituted by other known moving means without detracting from this function. For example, the gas moving device 41*b* could be replaced by mechanically equivalent devices such as a blower or a compressor or else by other gas motive means, such as, for example, a device using the venturi principle.

The heater 43*b* is a means for heating the warming gas before it pass through the steam turbines 20*b, c*. The heating maybe achieved by the use of a secondary heating transfer medium, such as steam or oil or else by any other known means such as by electric heating. In a not shown exemplary embodiment, the heating function is performed either partially or completely by utilising the thermodynamic effects of compression generated by the motive means.

As can be appreciated by the person skilled in the art, the order of the flow rate varying means 40*b*, the gas moving device and the heater 43*b* in the makeup line 36*b* as shown in FIGS. 5 and 6 may be changed without changing or influencing the combined function of these devices. In addition, the heater 43*a* and the gas moving device 41*a*, although shown as separate units in FIG. 1, the function of this devices may be combined into a single unit. Examples of such a single unit include a gas turbine or stroke engine.

The warming gas then passes into the second steam turbine 20*b* before passing through the third steam turbine 20*c* and exiting second warming system 30*b* through the condenser 24.

The path of the second warming gas through the steam turbines 20*b, c* is not limited to the nominal steam path through the steam turbines 20*b, c* but may include cooling flow paths, or else additional feed ports or extractions ports. By using these additional flow paths is it possible to ensure good contact of the second warming gas with all parts of the steam turbines 20*b, c* reducing the drying time and ensuring more uniform heating.

In another exemplary embodiment shown in FIGS. 5 and 6, the second warming system 30*b* is configured as a closed loop system comprising a recycle line 37*b* connected to the makeup line 36*b*. In an exemplary embodiment this connection is made between the second steam turbine 20*b* and the third steam turbine 20*c*. This makes it possible for some of the second warming gas to follow in a continuous loop around the second warming system 30*b* and thus reduce the amount of makeup/bleed required and as a consequence reduce the heater 43*a* load required to hold steam turbine 20*b, c* at a given temperature. This reduces the overall energy requirement to hold the steam turbines 20*b, c* on hot standby.

Exemplary embodiments shown in FIGS. 5 and 6 further include a moisture measurement device 52*b* located in the recycle line 37*b* and a controller 50. The control is configured to control at least one of a selection of temperature and flow-rate of the warming gas in the warming system. This can be achieved by modulating the control valve 40*b*, modulating the gas moving device 41*b* or else modulating the energy input in the heater 43*b*. In an exemplary embodiment, the measured variable of the controller is a measurement taken from the moisture measurement device 52*b* located in the recycle line 37*b*. In this way the controller 50 is able to control at least one process condition e.g. temperature or flow-rate, of the second warming system 30*b*, based on the second moisture measurement of the moisture measurement device 52*b*.

In an exemplary embodiment shown in FIG. 4, either or both the first warming system 30*a* or the second warming system 30*b* respectively extend to further include a warming gas flow path that includes a portion of the nominal main steam entry flow path into the first steam turbine 20*a* and/or the second steam turbine 20*b* respectively. In an exemplary embodiment, this extended flow path includes turbine feed valves 44 located in the respective turbine feed lines 45. These exemplary embodiments may include further gas moving devices 41*a*, or their equivalences, in the extended flow path to enable controllable and variable flow through the feed lines 45, and thus enable independent heating or drying of the feed line 45.

An exemplary method that may be applied to the described exemplary embodiments and their equivalences includes a drying step that involves flowing a warming gas through a steam turbine 20*a,b,c*, determining a pressure in the steam turbine and varying a flow rate of the warming gas through the steam turbine 20*a-c* based on the determined pressure thus making it possible control the pressure within a range that minimise losses, via vents 38, feed lines 45 and exhaust lines 47 while ensuring that the pressure within the steam turbine 20*a-c* prevents the ingress of air into the steam turbine 20*a-c*.

Although the disclosure has been herein shown and described in what is conceived to be the most practical exemplary embodiments, it will be appreciated that the present disclosure can be embodied in other specific forms. The presently disclosed embodiments are therefore considered in all respects to be illustrative and not restricted. For example, while in the Figs. the heater 43*a, b* and fan 41*a, b* are shown as being located in the make-up line 36*a, b*, they could alternative be located in the recycle line 37*a, b* and achieve the same purpose. In addition the warming arrangement could be configured as a mobile unit that is detachable, transportable and transferrable to another steam turbine. The scope of the disclosure is therefore indicated by the appended claims rather that the foregoing description and all changes that come within the meaning and range and equivalences thereof are intended to be embraced therein.

The invention claimed is:

1. A warming arrangement, for a power plant, comprising:

a first steam turbine, for expanding steam; and a first warming system, for warming the first steam turbine using a first warming gas, the first warming system includes:

a first makeup line, fluidly connected to the first steam turbine, for directing the first warming gas into the first steam turbine;

a first recycle line, fluidly connected to the first steam turbine, for conveying the first warming gas from the first steam turbine, a first gas moving device, in either the first makeup line or the first recycle line, configured and arranged to move the first warming gas through the first warming system;

a first heater, in either the first makeup line or the first recycle line so as to heat the first warming gas before it enters the first steam turbine;

a first pressure measurement device configured and arranged to determine a gauge pressure in the first steam turbine;

a first moisture measurement device located and arranged to estimate a moisture content of the first warming gas in the first steam turbine; and a controller, configured to control a flow rate of the first warming gas through the first steam turbine, based on the first pressure measurement device, and configured to control at least one of a temperature of the first warming gas and the flow rate of the first warming gas based on the moisture content measured by the first moisture measurement device;

wherein the first steam turbine has a feed line and an exhaust line which in combination are arranged to direct a main steam through the first steam turbine during operation, wherein points of connection of the first makeup line to the first steam turbine and points of connection of the first recycle line to the first steam turbine are distinct and separate from points of connection of the feed line to the first steam turbine and points of connection of the exhaust line to the first steam turbine.

2. The arrangement of claim 1 wherein the controller is configured and arranged to control the flow rate by the first gas moving device.

3. The arrangement of claim 1 wherein each of the first makeup line and the first recycle line includes at least one block valve for isolating the first warming system from the first steam turbine during operation of the first steam turbine.

4. The arrangement of claim 1 wherein the first moisture measurement device is located in the first steam turbine.

5. The arrangement of claim 1 further comprising a heat recuperator, spanning the first makeup line and the first recycle line, for exchanging thermal energy between the first warming gas flowing through the first makeup line and the first recycle line respectively.

6. The arrangement of claim 5 wherein the first gas moving device is located in the first makeup line upstream of the heat recuperator.

7. The arrangement of claim 1 wherein an end of the first recycle line is connected to the first makeup line to create a circular first warming gas flow path that includes the first steam turbine, the first gas moving device and the first heater.

8. The arrangement of claim 7 wherein the first recycle line is connected to the first makeup line by a control valve wherein the control valve includes the circular first warming gas flow path therethrough from:

the first recycle line to the first makeup line, so as to enable a flow ratio of warm gas entering the circular first warming gas flow path and circulating around the circular first warming gas flow path to be varied.

9. The arrangement of claim 1 further comprising a second steam turbine and a second warming system for warming the second steam turbine using a second warming gas.

10. The arrangement of claim 9 the second warming system further comprising:

a third steam turbine for further expanding steam from the second steam turbine; and a condenser connected to an outlet of the third steam turbine.

11. The arrangement of claim 1 wherein the first steam turbine includes a plurality of makeup lines, each makeup line of the plurality of makeup lines having a respective end point wherein each end point is fluidly connected to and axially distributed along the first steam turbine so as to enable a plurality of warming gas streams to be fed into the first steam turbine.

12. The arrangement of claim 11 wherein the first warming system further includes a temperature measurement device that is connected to the controller wherein the temperature measurement device is configured and arranged to measure a temperature of the first steam turbine.

* * * * *